US005451922A

United States Patent [19]

Hamilton

[11] Patent Number: 5,451,922

[45] Date of Patent: Sep. 19, 1995

[54] METHOD AND APPARATUS FOR PACING AN ATHLETE

[76] Inventor: Frederick C. Hamilton, 3910 Comanche Ct., SW., Grandville, Mich. 49418

[21] Appl. No.: 973,083

[22] Filed: Nov. 6, 1992

[51] Int. Cl.[6] ..... G08B 1/00

[52] U.S. Cl. ..... 340/309.15; 340/323 R; 368/10; 482/3; 482/74

[58] Field of Search ..... 340/323 R, 309.15, 996; 368/10, 108; 434/255; 482/3, 74; 381/88

[56] References Cited

U.S. PATENT DOCUMENTS

| | | | |
|---|---|---|---|
| 2,457,968 | 1/1949 | Allen et al. | 177/337 |
| 3,119,610 | 1/1964 | Clinton | 272/4 |
| 3,492,582 | 1/1970 | Heywood | 325/66 |
| 3,575,575 | 4/1971 | Kean | 340/996 X |
| 3,846,704 | 11/1974 | Bessette | 325/66 |
| 3,882,480 | 5/1975 | Greber | 340/323 R |
| 3,893,099 | 7/1975 | Zoepfl | 340/323 R |
| 4,028,693 | 6/1977 | Kuntz | 340/323 R |
| 4,164,732 | 8/1979 | Pischiera | 340/323 R |
| 4,220,996 | 9/1980 | Searcy | 364/561 |
| 4,285,041 | 8/1981 | Smith | 364/415 |
| 4,334,190 | 6/1982 | Sochaczevski | 324/171 |
| 4,396,904 | 8/1983 | Hanaoka | 340/309.15 |
| 4,510,485 | 4/1985 | Tahara | 340/323 R |
| 4,682,363 | 7/1987 | Goldfarb et al. | 381/88 X |

*Primary Examiner*—Jeffery A. Hofsass

*Attorney, Agent, or Firm*—Price, Heneveld, Cooper, DeWitt & Litton

[57] ABSTRACT

A method and apparatus for pacing an athlete along a predetermined course having at least one visual marker located thereon to be used in conjunction with a prerecorded narrative message indicating when the athlete should be adjacent the visual marker and for providing motivational support to the athlete along the length of the course. The device includes a means worn by the athlete for playing back any one of a plurality of prerecorded messages, each corresponding to a specific distance and performance goal. The plurality of messages may be stored on an archival medium such as a magnetic tape or electronic chip which, when played back, produces an audio narrative message heard by the athlete. Each narrative message continuously provides the athlete an update of the time into the event, the remaining in the event, the time between successive visual markers, and motivational support. The method includes locating at least one visual marker along a predetermined course and actuating the pacing device at the beginning of the course. The athlete adjusts his stride as dictated by the narrative message in order to pass each of the visual markers when indicated in the message. Thus, the pacing device allows the athlete to build his physical stamina and improve his performance to meet the desired goal.

18 Claims, 1 Drawing Sheet

METHOD AND APPARATUS FOR PACING AN ATHLETE

FIELD OF THE INVENTION

The present invention relates to an electronic pacing device and particularly to a method and apparatus for pacing and motivating an athlete along a predetermined course corresponding to a performance goal established by the athlete.

BACKGROUND OF THE INVENTION

A common problem in many athletic events is the ability of the athlete to maintain a proper pace in accordance with training, so that maximum results may be achieved for a given effort. Athletic achievements are improved when the athlete properly paces himself along the entire course, thus conserving as much energy as possible for a strong finish. In many cases, an athlete follows a pace which exceeds his physical ability, thus leading to early exhaustion and a poor finish than had a lesser pace been maintained throughout the event.

Early methods of pacing athletes used another individual running with the athlete. Alternatively, another individual timed and recorded the athlete's performance and related it back to him, either at certain intervals during the performance or at the conclusion of the event. However, this has often proved to be inaccurate, distracting, and sometimes ineffective, particularly in certain events where the athlete required continuous feedback, such as skiing and/or swimming. In one pacing device, a radio receiver was worn by the athlete which received a radio signal transmitted by the coach through a transmitter. The coach, observing the athlete's performance, spoke to the athlete through the transmitter, giving an indication of the athlete's performance. More recently, electronic pacing devices have been developed which produce a tone or pulse at regular intervals controlled by the athlete. The athlete then steps or strides in rhythm to the repeating pulses. Some electronic pacing devices calculate distance covered by the athlete based upon the length of the athlete's stride.

Other pacing systems rely primarily on visual signals. One example used on an oval race track required a series of wayside signals preferably arranged around the inside or post side of the track at short intervals where they were visible to a runner traversing the track. The wayside signals may have been in the form of lamps or any other signal, resting or imbedded in the ground, or arranged on elevated posts. Each successive wayside signal was lit at the pacing interval selected by the athlete. In another technique, a projected spot of light was uniformly moved around the track on the jogging surface to provide a moving and pace setting spot of light. A light located at the center of the track was mechanically actuated so that the beam fell upon the track surface at the pace established by the athlete.

U.S. Pat. No. 3,893,099 discloses the use of a conventional audio oscillator circuit and associated speaker worn by the athlete. The length of the time interval produced by the oscillator may be adjusted by the user in accordance with the requirements for a particular athletic event, as well as the frequency of associated distance markers which are placed at regular intervals along the course of the event. The tones provided by the oscillator are short in duration and occur at regular intervals which are substantial when compared with duration of the tone.

None of the techniques or devices briefly described above provide a small, lightweight and portable pacing mechanism which continuously informs the athlete of his exact time at regular or irregular set destination points, from start to finish of a timed event. Moreover, none of the above techniques or devices provide a narrative message which continuously gives feedback and motivation to the athlete along the course. Furthermore, none of the above devices offer a lightweight, portable system which an athlete can compete against in training and for sport.

SUMMARY OF THE INVENTION

The instant invention provides a method and pacing device for pacing an athlete along a predetermined course. The pacing device includes a plurality of prerecorded narrative messages, each providing a pace and motivational message which corresponds with the performance goal established by the athlete. The athlete selects the appropriate pacing message and locates a plurality of visual markers along the course which correspond to intervals contained in the message. At the start of the race or training event, the athlete plays the recorded message which continuously informs him of his progress and motivates him to maintain the pace.

The advantages provided by the invention include a simulation of a lifelike challenge which pulses the athlete to higher limits of conditioning. The method and apparatus also help the athlete maintain a steady pace resulting in a conservation of energy which may be used at the end of the event. The invention also informs the athlete in narrative form of his progress along the course and whether he is leading or lagging the established pace. Furthermore, as a result of the invention, the athlete builds confidence and physical stamina to achieve higher goals of conditioning.

These and other objects, advantages, purposes and features of the invention will become more apparent from a study of the following description taken in conjunction with the drawing figures described below.

DETAILED DESCRIPTION OF THE THE PREFERRED EMBODIMENTS

Figure 1:
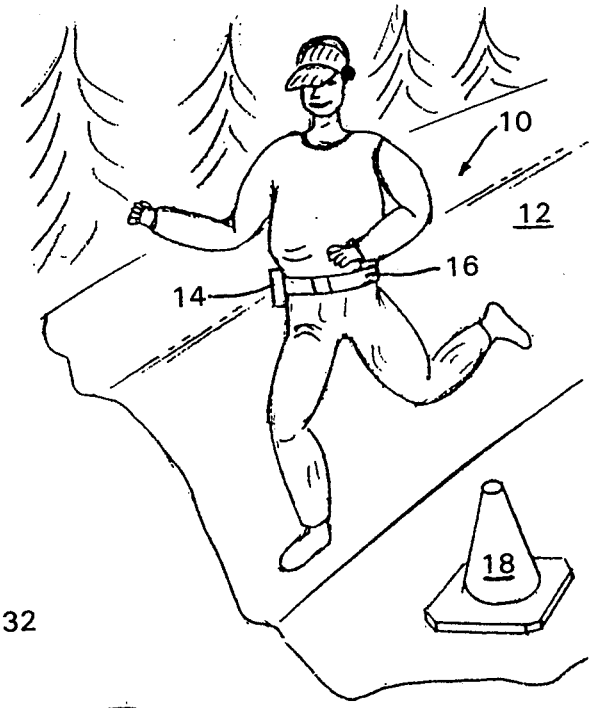
FIG. 1 generally illustrates one use of the instant invention by an athlete.

For purposes of the following description, the terms "upper," "lower," "right," "left, "rear," "front," "vertical," "horizontal" and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are not be be considered as limiting, unless the claims expressly state otherwise.

FIG. 1 illustrates an athlete running along a track or course 12. Although a runner is shown, the athlete may also be a race car driver, a jockey, a skier, or other athlete competing against time or another individual. Worn by the athlete 10, or placed in close proximity, is pacing device 14. For example, as shown in FIG. 1, pacing device 14 may be secured about the athlete's waist by a belt 16. Pacing device 14 may also be hand carried by athlete 10 or secured to an upper arm or any other location. Pacing device 14 should be located with respect to athlete 10 so that the athlete may be able to clearly hear the audio signal produced by device 14.

Used in conjunction with pacing device 14 are one or more visual markers such as pylon or cone 18. Although ground resting markers 18 are disclosed, wall mounted, suspended or other types of markers may also be used as long as the athlete is able to visually identify them. Pylons or cones 18 are preferred since they require no other structure for support. Moreover, they often come in fluorescent colors and are readily available. The visual markers are located along course 12 at predetermined spaced intervals prior to the athlete's running of the course. The distance between successive visual markers depends upon the distance to be run and the time to complete the course, both of which are selected by the athlete.

Figure 2:
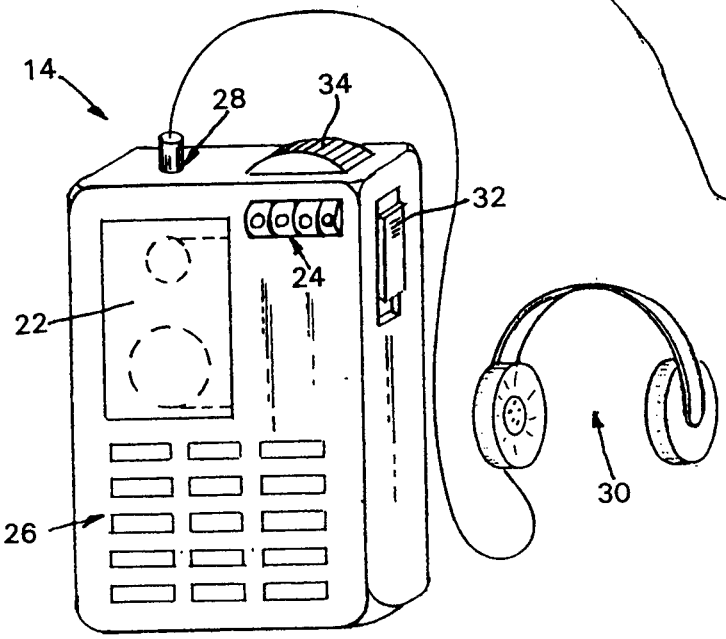
FIG. 2 generally illustrates one embodiment of the invention.

FIG. 2 is a generalized illustration of one contemplated embodiment of pacing device 14 used by athlete 10. In the preferred embodiment, pacing device 14 is composed of a cassette player 20, and most preferably a microcassette player containing a prerecorded tape 22. Tape player 20 also includes a tape counter 24, a speaker 26, and/or a jack 28 for coupling an earphone or headphone 30 thereto. Also included in tape player 20 are a manual control 32 for playing, rewinding or fast forwarding tape on cassette 22, and a volume control 34 for controlling the gain of the signal output through speaker 26 or accessory jack 28. It is preferred that the drive mechanism inside player 20 for moving the tape past the playing head have a playing speed substantially identical to the speed at which cassette 22 was recorded in order to maintain the timing accuracy of pacing device 14.

Prerecorded cassette tape 22 is a standard magnetic tape cassette of appropriate size for use in player 20. Recorded on the tape within cassette 22 are a plurality of narrative pacing programs, each containing a different message and specifically tailored for a given pace. For example, cassette 22 may contain five recorded messages, each designed to pace a track runner along a one mile long course. The first message may correspond to a pace for completing the course in five minutes. Each successive message may correspond to an incrementally faster pace than the previous message. Also recorded on cassette 22 are tones or narration which indicate when the athlete should be approaching one of the visual markers located adjacent the course.

Instead of pacing device 14 producing rhythmic monotone signals to which the athlete matches his stride, the narrative message contained on cassette 20 is a voice, actual or synthesized, which indicates to the athlete, on a continuous basis, time into the event, the time remaining and where he should be on the course. Moreover, the voice also provides motivational messages for the athlete.

The location of each message for a given tape is indicated by reference to tape counter 24. A separate schedule accompanying pacing device 14 lists each pacing message and references its location by the tape counter.

Figure 3:
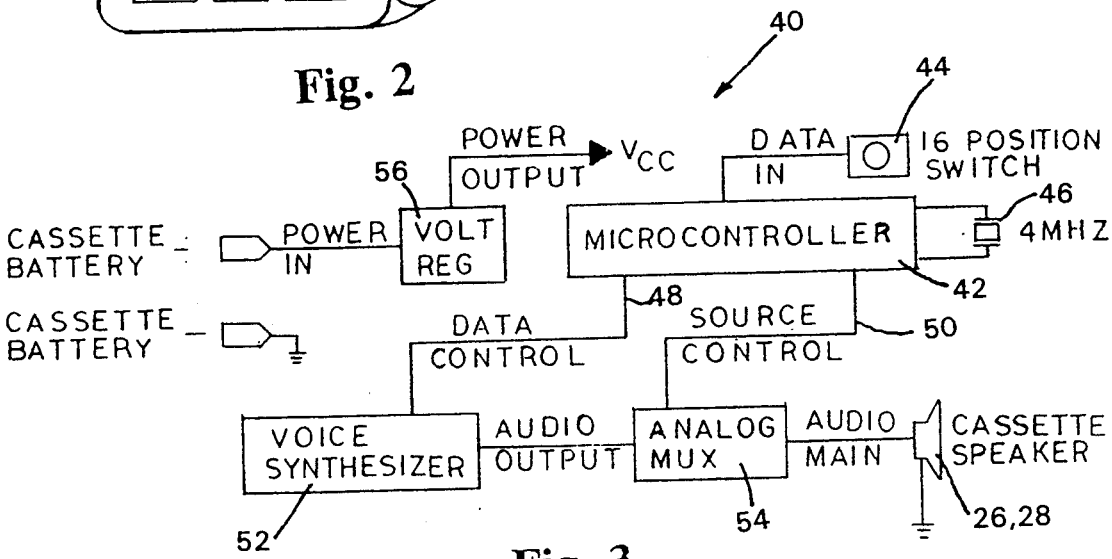
FIG. 3 is a schematic diagram of a timing device for use in conjunction with this invention.

Because the timing of the narrative message for a given event is directly related to the playing speed of the tape player, it is contemplated that an electronic timing mechanism 40 such as shown in FIG. 3 may be incorporated within pacing device 14. It is preferred that timing mechanism or circuit 40 be a solid state microprocessor controlled system powered by the same power supply for pacing device 14, such as batteries. A microcontroller or processor 42 is operably coupled to receive data input either from a multiple position switch 44 or from a digital signal prerecorded at the beginning of each event. Switch 44 or its digitally recorded equivalent dictates the period of the timing sequence. If a 16-position switch 44 is used such as manufactured by C & K, such a switch converts location into a 4-bit binary output which is input to, and controls the elapsed time counted by the mechanism. Alternatively, the binary output may be contained at the beginning of each timed event on cassette 22. Microprocessor 42 is also operably coupled to a 4 megahertz crystal 46 used to generate the clock pulses. Outputs 48 and 50 from microprocessor 42 represent data control and source control lines, respectively, which are coupled to a microchip voice synthesizer 52 and an analog mux 54. For example, microprocessor 42 may be a microchip model number P1C16C54. The voice synthesizer chip 52 can be obtained from Information Storage Devices. The analog mux 54 may be a Maxim brand model MAX333. Microprocessor 42, operating from the 4 megahertz crystal 46, determines the timing sequence, measures elapsed time, controls voice synthesizer 52, and switches the audio signal via analog mux 54 to the speaker 26 or auxiliary jack 28 to be heard by the user. Voice synthesizer 52 is preprogrammed with voice information stored in its memory. The voice information is accessed via microprocessor 42. The stored voice information is then passed through the existing amplifier circuit present in pacing device 14 and passed to analog mux 54 before passed to speaker 26 or jack 28. Analog mux 54 also switches the output signal produced by cassette 22 to the audio output 26 or 28. The timing circuit measures the elapsed time as controlled by the binary coded input. The last 10 or 15 seconds of the elapsed period are counted down in seconds using the voice produced by synthesizer 52. The timing circuit is operated directly by the power supply for device 14. Power is conditioned and boosted to nominal operating voltage by voltage regulator 56 which supplies power to all the control circuitry. The entire timing mechanism is capable of being produced using conventionally available components to fit within a volume 1.5 inches$\times$1 inch$\times$0.125 inch; small enough to fit within device 14.

An alternate embodiment of pacing device 14 may be microchip circuitry instead of the cassette tape. It is not beyond today's technology that solid state electronic circuits can store voice or synthesized messages which may then be played back. Moreover, such circuits can be contained in a small lightweight package. Such a package may include a keyboard or similar interface so the user can. indicate the length of the course to be followed, the intervals between successive visual markers and the desired time in which to complete the course. The package may then easily compute the pace and play a section of prerecorded narrative motivational messages throughout the event. As in the previous embodiment, output of the message may be through a speaker in the device or through headphones attached to the device.

In operation, the athlete determines the distance of the event or course and the performance goal in which he seeks to complete the course. Using the tape counter, the athlete advances or rewinds the tape to the designated location. The athlete has also located the visual markers along the course at intervals dictated by the pacing device. At the beginning of the course, the athlete moves control 32 on player 20 to the "PLAY" position to begin the pacing narrative. A cue may be recorded on the tape to indicate timing has started. The narrative message plays while the athlete is on the course, providing him continuous updates of time passed, how much time is remaining in the event and when he should be passing the visual markers. Moreover, the recorded message also motivates the athlete to maintain the pace and reach the next visual marker on time. At the completion of the paced event, the athlete moves the control to the "STOP" position and may wind the tape to the appropriate location, depending upon the event.

In the embodiment utilizing timing circuit 40, the operator selects the appropriate elapsed time interval through switch 44 prior to the event. Alternatively, cassette 22 may already have the binary-coded signal prerecorded on the tape at the beginning of each event. The user indicates that he has begun to run the event either by starting the tape or using some other manually depressed switch to cue the tape and timing device. As before, the tape narration indicates to the user where he should be on the course to match the pace. At periodic and predetermined intervals, the narration indicates when a marker is about to be passed. Concurrently with the narration, device 40 is accurately counting the elapsed time. In the last 10 or 15 seconds of the elapsed interval, synthesizer 52 counts out the exact time remaining in the event.

It is contemplated that this invention may be made so that the prerecorded cassette tape cannot be removed from player 20. Given the advances in electronics, player 20 and tape 22 may be sold as an integral unit, each having a specific purpose, for example, a series of devices designed to pace an athlete along any one of the many track and field events. Others may be designed so a jockey may pace his racehorse along the course. Still other applications include motor racing, skiing, swimming, as well as other timed events.

Using the plurality of pacing programs recorded on pacing device 14, an athlete may train at a more disciplined pace toward his performance goal. Moreover, physical stamina and thus athletic ability may also be improved as a result of the method and apparatus of this invention.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows.

1. A method for pacing an athlete along a predetermined course, comprising:

locating a plurality of visual markers along said course at spaced intervals prior to pacing said athlete along said course; and starting a prerecorded narrative message with said athlete starting to follow said course, said prerecorded narrative message including identifying said visual makers corresponding to a particular pace selected by said athlete between successive ones of said plurality of markers to provide said athlete with a motivational stimulus and indication of his timed progress along said course.

2. The method of claim 1, further including:

selecting one of a plurality of prerecorded messages, each corresponding to a different performance goal to be established by said athlete; and playing the selected one of a plurality of messages using a lightweight and portable apparatus carried and started by said athlete at the beginning of the course.

3. The method of claim 2, further including said prerecorded message counting down the time remaining in the performance goal selected by the athlete.

4. The method of claim 3, further including:

said prerecorded message providing a narrative for motivating said athlete to maintain the pace selected by said athlete; and indicating to said athlete when each successive visual marker should be reached by said athlete.

5. An apparatus for pacing an athlete along a predetermined course, comprising:

a plurality of visual markers, each located at spaced intervals along the course;

a device to be worn by the athlete for playing back one of a plurality of narrative messages stored on an archival medium, each narrative message including identifying said visual markers corresponding to a performance goal established by the athlete and providing motivational messages and an indication of the athlete's timed progress along the course;

means for selecting said different goal means for generating a clock pulse;

means operably coupled to said selecting means and generating means for controlling said device;

means for synthesizing a voice in coordination with certain ones of said clock pulses; and means for outputting said voice produced by said synthesizing means.

6. The apparatus of claim 5, wherein said archival medium includes a magnetic tape.

7. The apparatus of claim 5, wherein said archival medium includes a date storage device used in connection with a computer chip.

8. The apparatus of claim 6, wherein said device for playing back said narrative messages includes:

a tape player having a playing speed substantially identical to the speed said narrative messages were recorded;

a tape disposed within said tape player and containing said plurality of narrative messages;

an index in said tape player for selecting any one of said plurality of narrative messages on said tape; and a switch actuated by the athlete for starting any one of said plurality of narrative messages.

9. The apparatus of claim 5, wherein said device includes a timing device for accurately measuring an elapsed time of an event.

10. The apparatus of claim 9, wherein said timing device includes:

a microprocessor; and means for producing clock pulses.

11. The apparatus of claim 9, further including a signal generator couples to said timing device for generating an audio output indicating the time remaining in said event.

12. A lightweight and portable device for pacing an athlete along a predetermined course, comprising:

a plurality of visual markers for locating along a course at predetermined intervals;

means for recording and storing a plurality of narrative messages including identifying said visual markers thereon, each narrative message corresponding to a different performance goal to be selected by the athlete;

means for playing back said plurality of narrative messages as selected by the athlete, said playing means having means for starting and stopping said recording and storing means and means or selecting a specific one of said plurality of narrative messages, depending upon the performance goal of the athlete;

means for selecting said different goal;

means for generating a clock pulse;

means operably coupled to said selecting means and generating means for controlling said device;

means for synthesizing a voice in coordination with certain ones of said clock pulses; and means for outputting said voice produced by said synthesizing means.

13. The device of claim 12, further including:

means for providing power to said playing means; and means for attaching said playing means to the athlete.

14. The device of claim 12, wherein said means for recording and storing includes a magnetic tape enclosed in a housing for receipt with said playing means.

15. The device of claim 14, wherein said playing means includes:

a compartment for receiving the housing about said magnetic tape;

means in said compartment engaging said magnetic tape for detecting magnetic variations along said tape;

means engaging said tape for moving said tape across said detecting means;

means for converting said magnetic variations into an audible output; and means for moving said magnetic tape to a location marking a beginning of any one of a number of said narrative messages.

16. The device of claim 14, further including:

means in combination with said recording and storing means for accurately timing said different goals selected by the athlete.

17. The device of claim 12, wherein said controlling means directs said synthesizing means to generate said voice in response to the time remaining in the different goal selected by the athlete.

18. A lightweight and portable device for pacing an athlete along a predetermined course having a plurality of visual markers for locating along a course at predetermined intervals, comprising:

an archival medium for recording and storing a plurality of narrative messages including identifying said visual markers thereon, each narrative message corresponding to a different performance goal to be selected by the athlete;

an apparatus for playing back said plurality of narrative messages as selected by the athlete, said apparatus having a switch for starting and stopping said narrative messages and selecting a specific one of said plurality of narrative messages, depending upon the performance goal of the athlete;

means for selecting said different goal;

means for generating a clock pulse;

means operably coupled to said selecting means and generating means for controlling said device;

means for synthesizing a voice in coordination with certain ones of said clock pulses; and means for outputting said voice produced by said synthesizing means.

* * * * *